US008657293B2

(12) United States Patent
Sindaco

(10) Patent No.: US 8,657,293 B2
(45) Date of Patent: Feb. 25, 2014

(54) TOSSING PROJECTILE TARGET GAME

(75) Inventor: Chad Sindaco, Phoenixville, PA (US)

(73) Assignee: Edison Nation, LLC, Charlotte, NC (US)

( * ) Notice: Subject to any disclaimer, the term of this patent is extended or adjusted under 35 U.S.C. 154(b) by 0 days.

(21) Appl. No.: 13/361,945

(22) Filed: Jan. 30, 2012

(65) Prior Publication Data

US 2012/0193873 A1 Aug. 2, 2012

Related U.S. Application Data

(60) Provisional application No. 61/437,004, filed on Jan. 28, 2011.

(51) Int. Cl.
*A63B 63/00* (2006.01)

(52) U.S. Cl.
USPC ..... 273/400

(58) Field of Classification Search
USPC ..... 273/398–402; 473/170, 172, 195, 196; D21/300, 302, 303, 312, 322, 324, 342
See application file for complete search history.

(56) References Cited

U.S. PATENT DOCUMENTS

| | | | | | |
|---|---|---|---|---|---|
| 569,140 | A * | 10/1896 | Nurick | 273/399 |
| 731,850 | A * | 6/1903 | Bradbury | 273/355 |
| 4,667,964 | A * | 5/1987 | Hickey | 473/172 |
| 4,877,256 | A * | 10/1989 | Falloon | 273/400 |
| 4,900,035 | A * | 2/1990 | Carmo | 273/401 |
| D330,227 | S * | 10/1992 | Franklin et al. | D21/303 |
| 5,290,040 | A * | 3/1994 | Boroski | 273/348.4 |
| 5,419,566 | A * | 5/1995 | Byrd | 273/402 |
| 5,853,335 | A * | 12/1998 | Self | 473/196 |
| D407,764 | S * | 4/1999 | Ashton et al. | D21/397 |
| D415,533 | S * | 10/1999 | Shost et al. | D21/303 |
| 6,179,295 | B1 * | 1/2001 | Lanza | 273/402 |
| 7,500,674 | B2 * | 3/2009 | Riley et al. | 273/400 |
| D615,130 | S * | 5/2010 | Smith | D21/303 |
| D645,520 | S * | 9/2011 | Dahl | D21/303 |
| 2004/0239036 | A1 * | 12/2004 | Fairbanks | 273/400 |
| 2009/0115136 | A1 * | 5/2009 | Voden | 273/336 |
| 2009/0200742 | A1 * | 8/2009 | Maietta | 273/401 |
| 2010/0320692 | A1 * | 12/2010 | Tookey | 273/398 |

* cited by examiner

*Primary Examiner* — Mark Graham
(74) *Attorney, Agent, or Firm* — Tillman Wright, PLLC; James D. Wright; David R. Higgins

(57) ABSTRACT

A projectile tossing game that combines elements of traditional washers and bean bag games with baseball. The game includes a receiving box that resembles a baseball field having an infield and outfield. The floor of the box can be covered with a material such as outdoor carpeting or turf to minimize the impact of projectiles landing in the box. Players score points (or runs) by landing projectiles in the infield or in one of the cylindrical outfield targets. The game is played for nine turns rather than a predetermined score. In the event of a tie, extra turns are taken until a player or team is declared the winner. The game can be played with multiple players and one receiving box or teams of players with two receiving boxes. A carrying case, handle, or lid may be provided to assist with transport of the game.

1 Claim, 1 Drawing Sheet

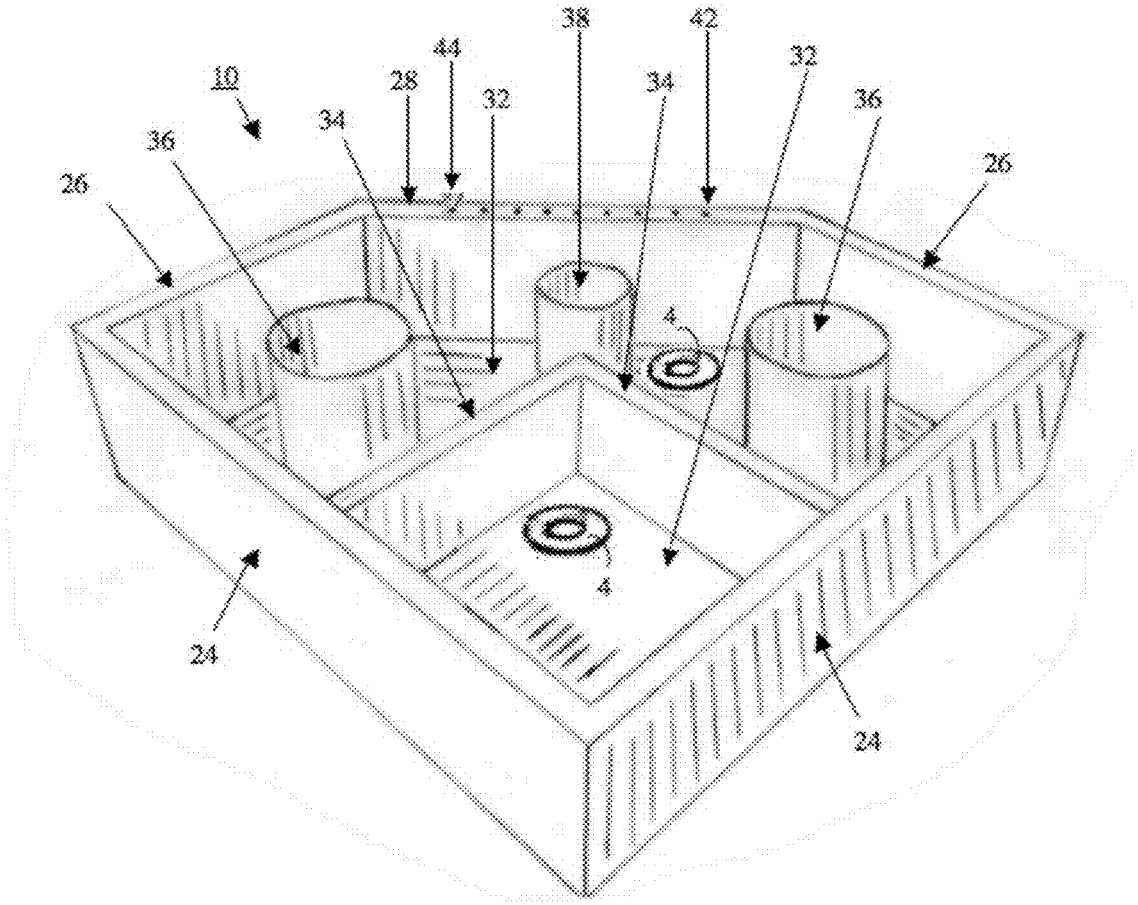
10
26
36
34
28
44
32
38
34
42
32
36
26
4
4
24
24

TOSSING PROJECTILE TARGET GAME

CROSS-REFERENCE TO RELATED APPLICATIONS

This application claims the benefit of U.S. Provisional Patent Application No. 61,437,004 filed on Jan. 28, 2011.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

The invention relates to the field of games that are played by which players toss a projectile towards a target or set of targets. Points are scored by landing projectiles in or near the targets. These games can be portable, lightweight, and compact. While enjoyable, the scoring method of these games to a set score can cause people to lose interest during games when points are not scored readily as projectiles are not landed in or near targets.

BRIEF SUMMARY OF THE INVENTION

Tossing target games are known in the prior art. This game combines the concepts found in the games of washers and baseball. Traditional washers is played by throwing a projectile, usually a metal washer, into a box that has a cup or can in the middle of it. The box is usually in the shape of a square, rectangle, or octagon. Points are scored by landing in the box or cup. Other formats of washers include boxes that are not recessed and have a circular hole, or series of holes cut in them that allow the projectile to fall through the opening.

Bean bag tossing games, sometimes referred to as corn hole, are played with target boards that are rectangular and rest on angle so that the end furthest from the player is elevated. The target boards have a hole cut into the board to receive the bean bag. Points are scored only when one of the bean bag flies or slides through the hole.

Games are usually played to a set score of twenty one and can take quite some time if points are not scored on every turn or if a scoring method is employed whereby opposing players points cancel each other out when both players land in or on a target.

Accordingly, the invention provides a receiving box shaped similar to a baseball field. The receiving box has an "infield" and "outfield". The outfield contains three cylindrical targets. Points can be scored by landing a set number of projectiles in the infield or in one of the cylindrical targets located in the outfield. In addition, the duration of the game is based on a set number of turns rather than reaching a predetermined score.

BRIEF DESCRIPTION OF THE VIEW OF THE DRAWING

FIG. 1 is a perspective view the target according to the preferred embodiment of the present invention.

DETAILED DESCRIPTION OF THE INVENTION

As required, detailed descriptions of the invention are provided. However, the preferred embodiment as provided is not to be interpreted as limiting. Structural and functional details disclosed are provided so that any person skilled in the art or science to which this invention pertains may make and use the same. It is to be understood that the invention can be embodied in various forms comprised of various materials or sizes.

Preferred Embodiment of Projectile Tossing Game 10

Referring to the drawings in more detail. The invention has a receiving box 10, toward which multiple projectiles 4, are tossed. The receiving box 10, consists of five perimeter sidewalls. The two longest sidewalls 24, are identical in length and are perpendicularly connected. Two shorter perimeter sidewalls 26, also identical in length, are perpendicularly connected to the other end of the longest sidewalls 24. The remaining sidewall 28, connects the two short sidewalls 26, completing the perimeter of the target 10.

The receiving box 10, has a floor 32, so that projectiles 4, landing within the receiving box are contained. The floor 32, can be covered with a material such as outdoor carpet, to absorb the impact of projectiles 4, when landing in the receiving box 10.

Two interior walls of identical length 34, are perpendicularly connected to one another. The height of the interior walls 34, is shorter than that of the exterior walls 24, 26, or 28. The height of the interior walls 34, could be varied to modify the level of difficulty. The remaining end of the interior walls 34, are connected to the longest perimeter sidewalls 24, thus forming a square within the receiving box 10, referred to as the "infield" of the receiving box 10.

The area of the receiving box 10, not located within the infield, is referred to as the "outfield". Two cylindrical targets 36, are of equal size, and are positioned in the center of the left and right portion of the outfield of the receiving box 10. One cylindrical target 38, is placed in the center of the outfield, equal distance from the perpendicular connection of the two interior walls 34, and the perimeter sidewall 28. The two large cylindrical targets 36, and small cylindrical target 38, are connected to the floor 32, of the receiving box 10.

Nine holes 42, of equal size are located across the top of perimeter sidewall 28. A marker 44, is placed in the holes 28, and moved as turns are completed during the game.

In use, the receiving box 10, will be positioned with the infield closer to the players of the game. Each player will throw a set number of projectiles toward the receiving box 10. Points can be scored by landing a predetermined number of projectiles in the infield or in one of the cylindrical targets 36 or 38, in the outfield. Projectiles landing in the outfield, but not in a cylindrical target 36 or 38, or outside of the receiving box 10, will not be awarded any points. Projectiles landing in the smaller cylindrical target 38, will be awarded more points than those landing in the infield or in the larger cylindrical targets 36.

One system of awarding points may be comprised of the following. Each player will throw four projectiles per turn. One point will be awarded for landing three projectiles in the infield. One point will be awarded for landing a projectile in one of the large cylindrical targets 36. Two points will be awarded for landing a projectile in the small cylindrical target 38. Four points will be awarded for landing the first three projectiles in the infield and the fourth projectile in the small cylindrical target 38.

After each player completes a turn, the marker 44, is moved over one hole in the holes located across the top of perimeter sidewall 28. After nine turns, the player with the most points is declared the winner. In the event of a tie, extra turns are taken until a player wins.

The game can be played with multiple players tossing projectiles toward one receiving box, or teams of players with two receiving boxes across from one another, with members of each team standing at each end in a fashion similar to that of horseshoes or other traditional target tossing games.

Score can be kept in a fashion similar to that utilized to keep track of turns taken during the game. A series of additional holes might be located across other perimeter sidewalls and utilize additional markers to keep track of points scored.

The level of difficulty can be modified by laying the receiving box 10, flat on the ground or tilted on an angle toward the players tossing the projectiles. The receiving box could rest on a separate attachment(s) to achieve such angle.

Projectiles 4, can be comprised of sets of flat washer-like discs or bean bags. Projectiles 4, can be varied based on location played and skill level of players. The materials used to construct the perimeter and interior walls of the receiving box and the cylindrical targets can be modified based on durability, aesthetic, and economic preferences.

A carrying case could be provided or a handle could be attached to one of the perimeter sidewalls to assist with transport. A lid could be fashioned to fit over the cylindrical targets to contain projectiles and the marker.

If two fields are used, a latching system could hold the two fields together so that the bottom/floor of the fields are facing out, containing all game components inside.

What is claimed is:

1. A projectile tossing game for players to score the tossing of plural projectiles to a receiving box comprising: five perimeter side walls comprised of; two long sidewalls perpendicularly connected; two short perimeter sidewalls connected perpendicularly to the other end of the long perimeter sidewalls; one medium perimeter sidewall that connects the remaining end of the two short perimeter sidewalls; a floor secured to all five sidewalls thus containing projectiles landing in the receiving box; two interior walls connected perpendicularly to one another and to the long sidewalls also perpendicularly forming a smaller square within the receiving box; two large cylindrical targets each attached to the floor between the square area and one of the short perimeter sidewalls; one small cylindrical target attached to the floor and centered between the intersection of the two interior walls and the center of the medium perimeter sidewall.

* * * * *